US005683114A

United States Patent [19]

Lauer et al.

[11] Patent Number: 5,683,114

[45] Date of Patent: Nov. 4, 1997

[54] RESIDENTIAL PLACARD SYSTEM

[76] Inventors: Mark Lauer, 105 S. Church St.,, Felton, Pa. 17322; Michael Z. Schmidt, R.D. #4, Box 40309, Glen Rock, Pa. 17327

[21] Appl. No.: 637,178

[22] Filed: Apr. 24, 1996

[51] Int. Cl.[6] ..... B42D 15/00

[52] U.S. Cl. ..... 283/74; 283/46; 283/72; 283/115

[58] Field of Search ..... 283/72, 74, 81, 283/114, 46, 115, 117; 40/1, 594, 595

[56] References Cited

U.S. PATENT DOCUMENTS 4,156,539 5/1979 Davidson et al. ..... 283/46 X
4,235,459 11/1980 Callahan .
4,696,706 9/1987 Griffin et al. .
4,795,348 1/1989 Garthwaite ..... 283/46 X
4,802,855 2/1989 Wood ..... 283/46 X
5,261,702 11/1993 Mayfield .

*Primary Examiner*—Willmon Fridie, Jr.
*Attorney, Agent, or Firm*—Samuel M. Learned, Jr.

[57] ABSTRACT

A residential placard system comprised of adhesive letters and numbers with a symbol color-coded backing adapted to be assembled and provide a customized visual information window display alert for emergency personnel, and particularly firemen, in quickly and efficiently determining and identifying the occupancy status and circumstances existent within a household residence at a time of call response, wherein the letter and number components of the system are affixed in an array upon the symbol color-coded backing base carrier in a standardized format known to emergency personnel, which display may be conveniently made current to up-date changed occupancy status and circumstance conditions within a household residence.

19 Claims, 5 Drawing Sheets

NIGHT SLEEPER
ONE SLEEPING AREA
NO CHILDREN
ONE OCCUPANT
NO SPECIAL FIRE HAZARDS
SENIOR CITIZEN
NO OXYGEN IN USE
NO HANDICAPPED
PETS
N
S
P
0
1
1
1
24
26
28
30
32
34
46

DAY SLEEPER
BASEMENT SLEEPER
ONE SLEEPING AREA
NO CHILDREN
ONE OCCUPANT
NO SPECIAL FIRE HAZARDS
NO SENIOR CITIZENS
NO OXYGEN IN USE
NO HANDICAPPED
NO PETS
D
B
0
1
1
26
28
30
32
34
46

NIGHT SLEEPER
ONE SLEEPING AREA
NO CHILDREN
ONE OCCUPANT
SPECIAL FIRE HAZARDS
NO SENIOR CITIZENS
OXYGEN IN USE
HANDICAPPED
PETS
N
F O H P
1
0
1
46
24
26
32
30
28
34

DAY SLEEPER
NIGHT SLEEPER
TWO SLEEPING AREAS
NO CHILDREN
TWO OCCUPANTS
NO SPECIAL FIRE HAZARDS
NO SENIOR CITIZENS
NO OXYGEN IN USE
NO HANDICAPPED
PETS
D N
P
2
0
2
46
24
26
32
30
28
34

RESIDENTIAL PLACARD SYSTEM

COPYRIGHT

A portion of the disclosure of this patent document contains material which is subject to copyright protection. The owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

The present invention relates to a residential placard system and the use thereof by a household resident in preparing and displaying a residential placard for purposes of quickly and efficiently alerting responding emergency personnel with indicia coded information thereon as to the occupancy status and circumstances existent within a household residence at a time of an emergency call response. Although not per se restricted to fire company response application, the residential placard system herein taught, and the use thereof, is particularly useful and effective in conveying vital household occupancy and status circumstance information to firemen at the time of arriving at a household residence fire scene.

A popular technique in the past for alerting responding firemen to the possible location of children in a residential household was to place a decal depicting a fireman on the nursery window or children's bedroom windows. This technique is effective so long as such a decal placement is valid for the household occupancy status of children. However, as is frequently the case, when a child grows up and leaves the household the decal remains, thus conveying false information to responding firemen which if unknowingly acted upon in searching a burning residence for children could expose emergency personnel to unnecessary risk and danger. Also, such a decal conveys no information regarding the total number of residents to be accounted for, the number and locations of other sleeping areas, the normal sleeping routines of the residents, whether any of the residents are handicapped or senior citizens, or whether there is oxygen in use in the household or there are any special or unusual fire hazards existent within the household. The residential placard system of instant invention provides a means to remedy the foregoing limitations of a simple decal technique as aforesaid.

The residential placard system hereof is functionally and structurally based upon the use of adhesive numbers and letters in combination being affixed to a symbol color-coded backing, whereby is prepared a customized placard to visually impart information on the occupancy status and circumstances existent within the household residence, which placard thus assembled is in turn then adhesively applied to a household residence window in a prominent display position. Characteristic of prior art teachings showing the application of adhesive symbols to a support backing for purposes of conveying coded information are those as respectively set forth in U.S. Pat. No. 4,235,459 to Callahan dated 25 Nov., 1980, which pertains to a key identification and marking system employing separable adhesive backed markers and a recording chart, and U.S. Pat. No. 4,696,706 to Griffin et al dated 29 Sep., 1987, which pertains to the use of adhesive symbols to prepare data processing flow charts for use in computer programming.

Lastly, in the teaching by Mayfield in her U.S. Pat. No. 5,261,702 dated 16 Nov., 1993, there is shown a medication management system employing the use of both tactile and adhesive applied coded medication symbols and marking elements to denote specific times for taking specific medications.

The applicants herein, by their invention teach a system and method which provides both new and novel approaches to effect the imparting of information on household residence occupancy status and circumstances existent within a household residence at the time of a call response by emergency personnel.

SUMMARY OF THE INVENTION

It is the principal object of the present invention to provide a residential placard system which will quickly, efficiently and reliably communicate to arriving emergency response personnel existing inhabitant count and locations, occupancy and special conditions, and hazards existent within a household residence at the time of an emergency response.

It is also an object of the present invention to provide a residential placard system having components comprised of an envelope carrier with assembly instructions imprinted thereon, a symbol color-coded backing, and a selection of adhesive letters and numbers for assembly thereto.

It is another object of the present invention to provide a residential placard system that enables a household residential occupant to employ the components thereof in creating and preparing a customized visual information window display to communicate a residence occupancy status and household circumstance alert notification for responding emergency personnel.

It is still another object of the present invention to provide a residential placard system that accommodates changes to enable up-date modifications thereof in maintaining currency of the household residential habitat circumstances and conditions.

It is yet another object of the present invention to provide a residential placard system that communicates and informs responding emergency personnel of multiple occupant and household environment conditions.

It is still a further object of the present invention to provide a residential placard system that communicates essential information to responding emergency personnel while at the same time maintaining household privacy and security.

It is even yet another object of the present invention to provide a residential placard system that is simple, affordable, and easy to manufacture and use.

The foregoing, and other objects hereof, will be readily evident upon a study of the following specification and accompanying drawings comprising a part thereof.

DETAILED DESCRIPTION OF THE INVENTION

Figure 1:
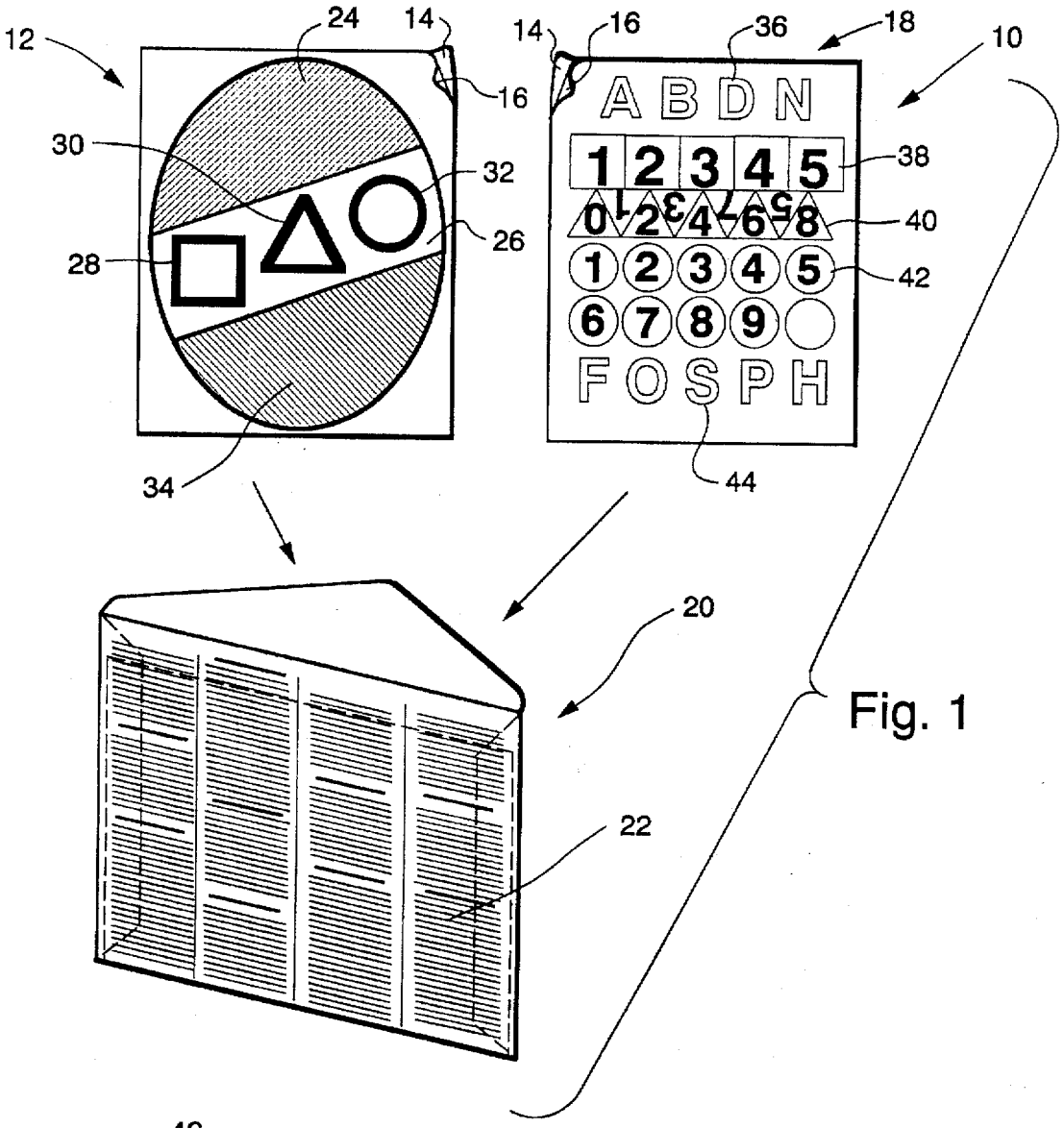
FIG. 1 illustrates the components of the residential placard system in accordance with the present invention.

Referring to FIG. 1, the residential placard system 10 of present invention and the major component parts thereof comprising the same are shown in a before-assembly condition, wherein the major component parts thereof are a symbol color-coded backing 12 which is releasably mounted to a backing carrier 14 the removal of which exposes the pressure sensitive adhesive side 16 thereof for display mounting to a support surface such as for example a window, a plurality of die-cut adhesive letters and numbers 18 likewise releasably mounted to a backing carrier 14 the removal of which also exposes the pressure sensitive adhesive sides 16 respectively thereof for application and adhesive retention to said symbol color-coded backing 12, and an envelope 20 having imprinted thereon instructions 22 as to the manner and technique for customized assembly and use of said residential placard system 10 and within which the component parts 14 and 18 are protectively retained until assembly and use.

Referring again to FIG. 1 to explain in greater detail various features of the component parts of said residential placard system 10, and considering first the symbol color-coded backing 12. As shown in FIG. 1, the backing 12 which constitutes the placard support carrier is preferably oval in shape for the purpose of being a distinctive silhouette easily recognizable by emergency personnel, and is faced with three different colored diagonally profiled panels, being a top panel 24 which is that portion of the placard reserved for coded information concerning the normal sleeping habits and locations of the residential household inhabitants, a contrasting colored center panel 26 bearing three distinctive geometric shapes respectively in the form of a square 28 and a triangle 30 and a circle 32 which in turn are respectively reserved for entry of the number of sleeping areas in the residential household and the number of children under 8-years of age and the total number of persons resident in the household, and yet another contrasting colored bottom panel 34 which is that portion of the placard reserved for coded information concerning special circumstances regarding residents and hazards that may be present in the household.

Considering next the die-cut adhesive letters and numbers 18 shown in FIG. 1, wherein the top letters 36 are for coded designation of information concerning the normal sleeping habits and locations of the residential household inhabitants for affixment entry in the top panel 24 as appropriate, the plurality of square numbers 38 are for affixment entry as appropriate in the center panel 26 square 28 to designate the number of sleeping areas in the household, the plurality of triangle numbers 40 are for affixment entry as appropriate in the center panel 26 triangle 30 to designate the number of children under 8-years of age resident in the household, the plurality of circle numbers 42 are for affixment entry as appropriate in the center panel 26 circle 32 to designate the total number of persons resident in the household, and the bottom letters 44 are for coded designation of information concerning special circumstances regarding residents and hazards that may be present in the household for affixment entry in the bottom panel as appropriate.

Figure 2:
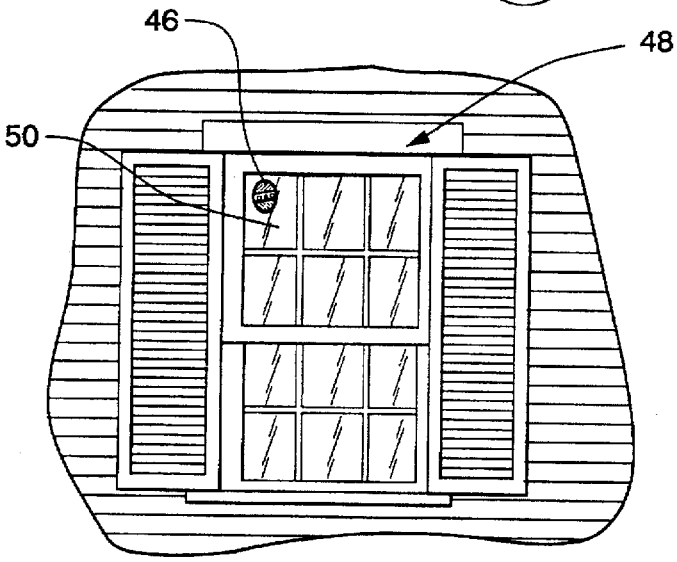
FIG. 2 depicts the operational use of an exemplary residential placard in a typical household residence use application.

The envelope 20 as shown in FIG. 1, with imprinted instructions 22, explains the above described mechanism to a householder for application entry of coded information by means of those letters and numbers from the die-cut adhesive letters and numbers 18, to the backing carrier 14, to prepare a customized residential placard 46 for use as shown in FIG. 2.

In FIG. 2 the application use of a customized residential placard 46 is shown in a typical exemplary residential household front window 48, being applied to a window pane 50 thereof by means of the pressure sensitive adhesive side 16 of the symbol color-coded backing 12.

Figure 3:
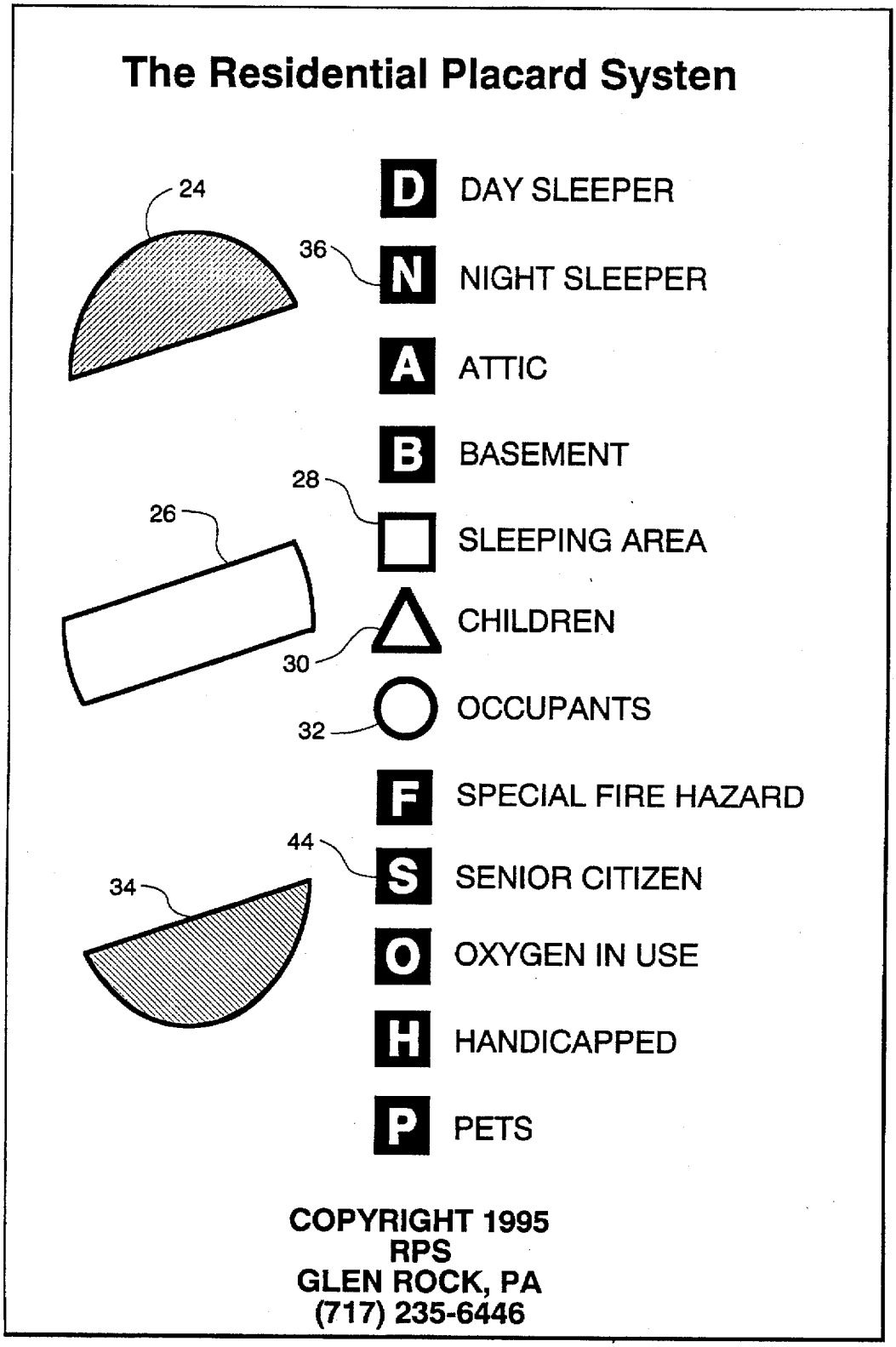
FIG. 3 depicts the symbols employed in designating household residence habitat circumstances and conditions.

Referring now to FIG. 3, wherein is shown a display of the coded symbols employed in designating household residence habitat circumstances and conditions, which display is adapted to be prepared into a convenient wallet-sized card for carry by emergency personnel as a reminder of the residential placard system coding scheme. As shown, and as previously described, the top letters 36 are placed in the top panel 24 to convey coded information concerning the normal sleeping habits of the residential household inhabitants, wherein D indicates day sleeper, N indicates night sleeper, A an attic sleeping area and B a basement sleeping area. The geometric symbols shown and as previously illustrated are imprinted on the center panel 26 wherein the square number 38 entered in the square 28 designates the number of sleeping areas in the residential household, the triangle number 40 entered in the triangle 30 designates the number of children under 8-years of age resident in the household, and the circle number 42 entered in the circle 32 designates the total number of persons resident in the household. The bottom panel 34 imparts coded information concerning special circumstances regarding residents and hazards that may be present in the household, wherein an F indicates a special fire hazard, an O that oxygen is in use, an S that a senior citizen is a household resident, an H that a handicapped person is a household resident, and a P that there is a household pet. It should also be noted that an absence of any particular designator on a residential placard customized to the household conditions and circumstances conveys the information that no such condition or circumstance is present.

Figures 4, 5:
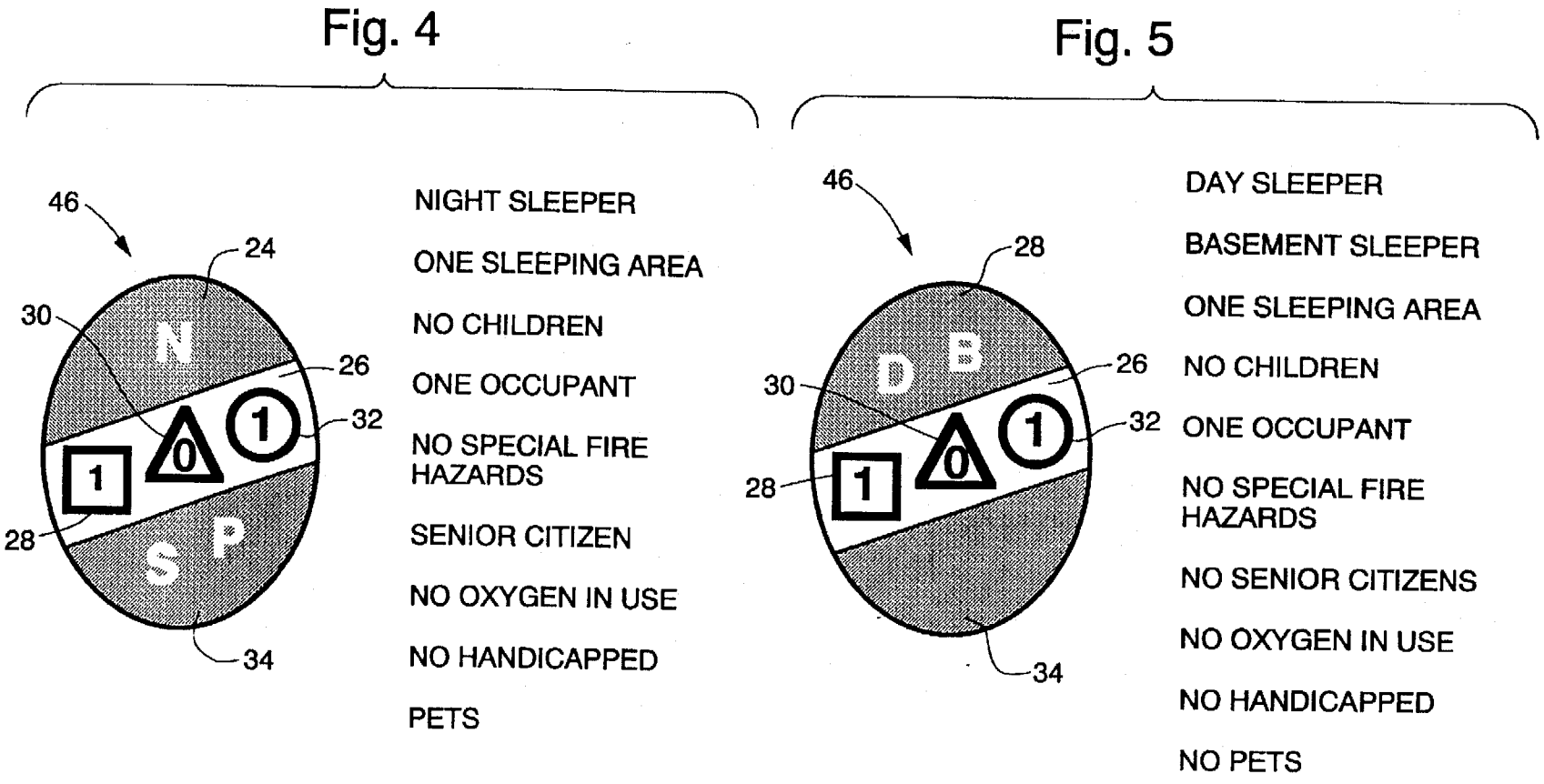
FIGS. 4–9 inclusive illustrate exemplary residential placards depicting typically different household residence habitat circumstance and condition information.

Turning attention now to FIGS. 4 through 9, wherein are illustrated various typical examples of exemplary customized residential placards 46 prepared to convey coded information concerning the occupancy conditions and circumstances of the respective exemplary households for which they were prepared, and considering first that exemplary customized residential placard 46 as shown in FIG. 4.

The exemplary customized residential placard 46 shown in FIG. 4 is for a single resident household and conveys the following information. The circle 32 numerical entry of the numeral 1 in the center panel 26 shows that the household has a total of one occupant. A zero entry in triangle 30 conveys that there are no children present in the household, and the square 28 numerical entry of the numeral 1 conveys that there is one sleeping area in the household.

In the top panel 24 of the exemplary customized residential placard 46 as shown in FIG. 4, wherein the top panel 24 is reserved to convey coded information concerning the normal sleeping habits of the residential household inhabitants, entry of the letter N designates that the single residential household occupant is a night sleeper. Entry of the letters S and P in the bottom panel 34 of FIG. 4, to show coded information concerning special circumstances regarding residents and hazards that may be present in the household, conveys the information that the single household resident is a senior citizen and that a pet is present in the household. In a like manner, the absence of an F, an O or an H in the bottom panel 34 of FIG. 4 conveys the information that there are no special fire hazards present, there is no oxygen in use in the household, and no handicapped persons are present in the household.

Directing attention now to the exemplary customized residential placard 46 as shown in FIG. 5, which is also for a single resident household and conveys the following information. Again, the circle 32 numerical entry of the numeral 1 in the center panel 26 shows that the household has a total of one occupant. The zero entry in triangle 30 conveys that there are no children present in the household, and the square 28 numerical entry of the numeral 1 conveys that there is one sleeping area in the household.

In the top panel 24 of the exemplary customized residential placard 46 as shown in FIG. 5, entry of the letters D and B designate that the single residential household occupant is a day sleeper and that the occupant's sleeping area is in the basement. A blank bottom panel 34 in FIG. 5 reflects that there are no special circumstances regarding residents and hazards that may be present in the household.

Figure 6:
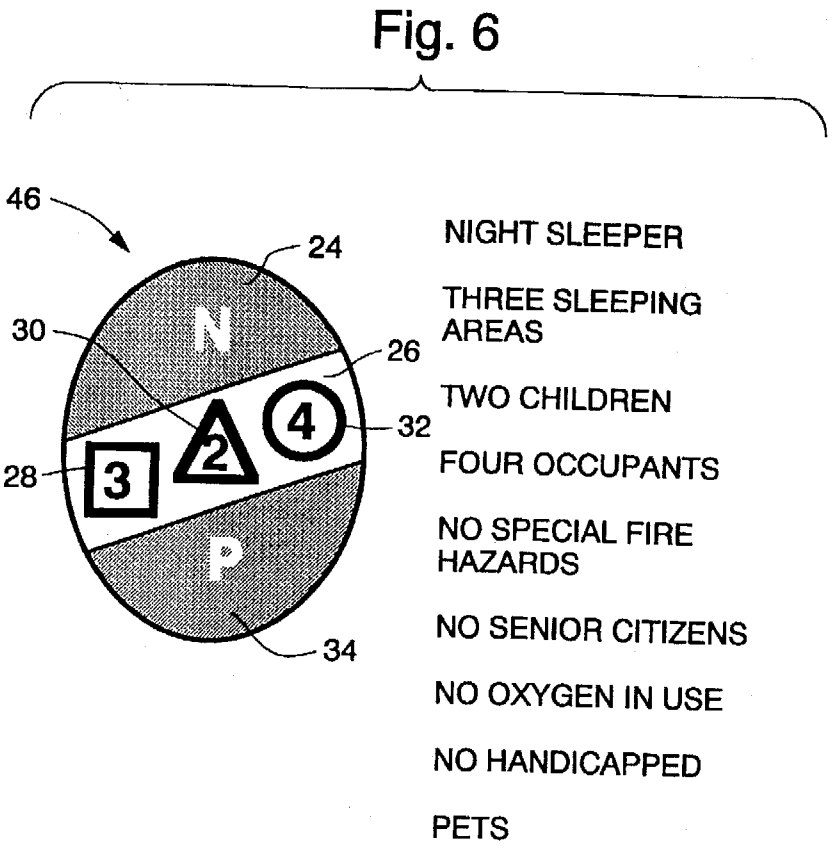

Turning now to a consideration of the exemplary customized residential placard 46 as shown in FIG. 6, which is for a household having four occupants as indicated by the center panel 26 circle 32 numerical entry of the numeral 4, and conveys the following additional information. The numeral 2 entry in the triangle 30 conveys that there are two children present in the household, and the square 28 numerical entry of the numeral 3 conveys that there are three sleeping areas in the household. In the top panel 24 of the exemplary customized residential placard 46 as shown in FIG. 6, entry of the letter N designates that the household occupants are night sleepers, and in the bottom panel 34 entry of the letter P conveys that there is a household pet.

Figure 7:
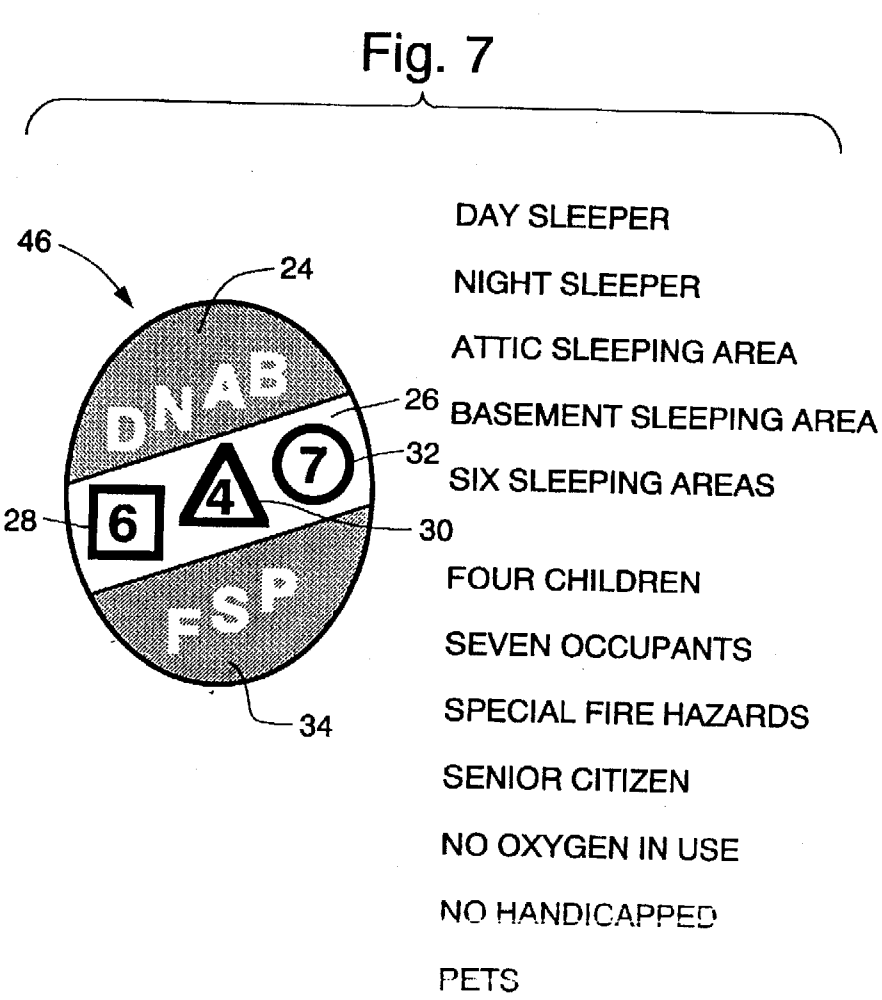

Directing attention now to the exemplary customized residential placard 46 as shown in FIG. 7, which is for a household having seven occupants as reflected by the center panel 26 circle 32 numerical entry of the number 7, and conveys the following additional information. The numeral 4 entry in the triangle 30 conveys that there are four children present in the household, and the square 28 numerical entry of the numeral 6 conveys that there are six sleeping areas in the household.

In the top panel 24 of the exemplary customized residential placard 46 as shown in FIG. 7, entry of the letters D, N, A and B designate that there are both day and night sleepers and that both the attic and basement are utilized as sleeping areas. Entry of the letters F, S and P in the bottom panel 34 of FIG. 4, to show coded information concerning special circumstances regarding residents and hazards that may be present in the household, conveys the information that there are special fire hazards present in the household, that a senior citizen is among the household occupants, and that there are household pets. There is, however, no oxygen in use nor any handicapped persons among the household residents.

Figures 8, 9:
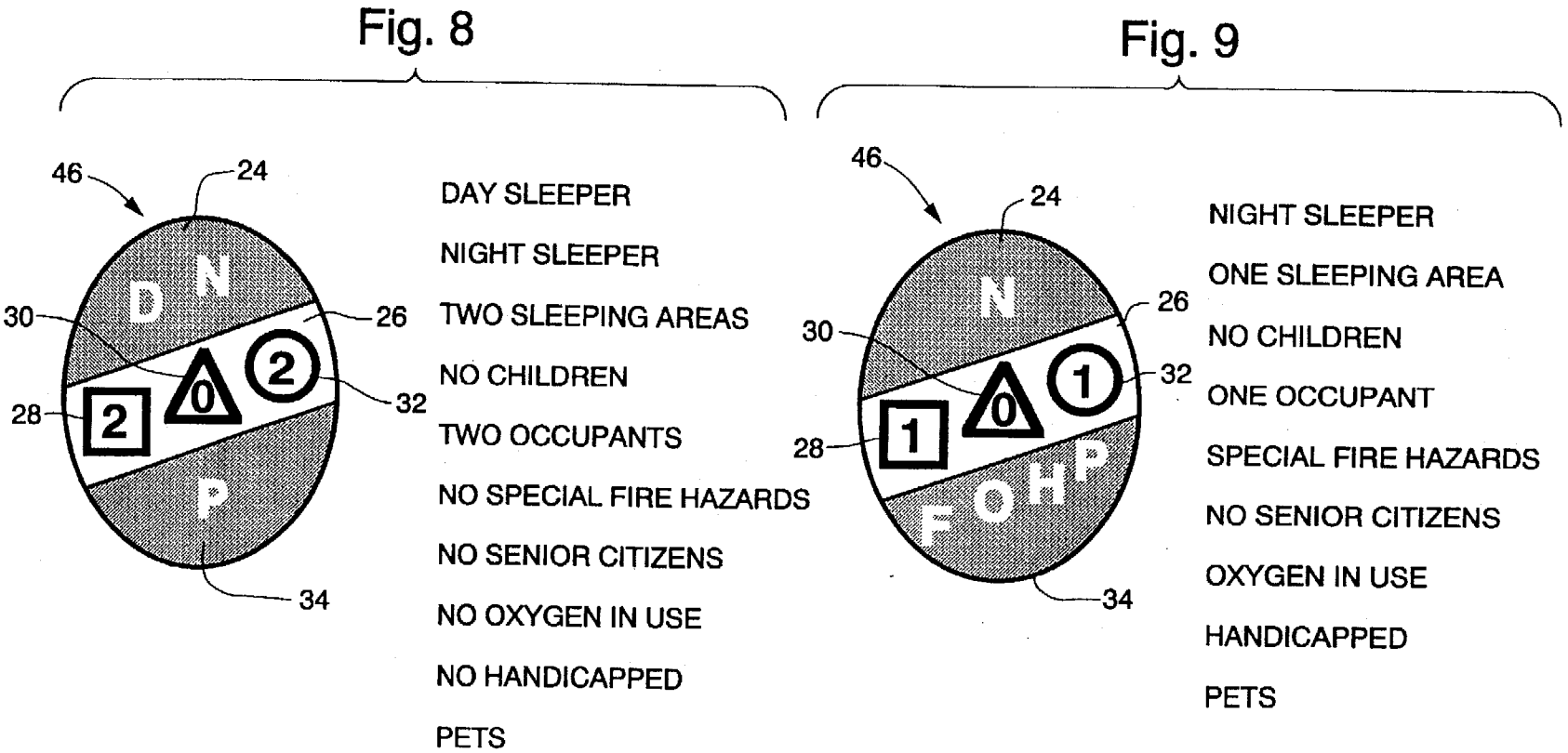

Considering next the exemplary customized residential placard 46 shown in FIG. 8, which is for a two resident household as is indicated by the circle 32 numerical entry of the numeral 2 in the center panel 26 and conveys the following additional information. A zero entry in triangle 30 of the center panel 26 denotes that there are no children present in the household, and the square 28 numerical entry of the numeral 2 conveys that there are two sleeping areas in the household.

In the top panel 24 of the exemplary customized residential placard 46 as shown in FIG. 8, the letters D and N respectively designate that one occupant of the household is a day sleeper and the other is a night sleeper. A P in the bottom panel 34 of FIG. 8 reflects that there is a pet present in the household.

Considering lastly the exemplary customized residential placard 46 shown in FIG. 9, which is for a single resident household as is indicated by the circle 32 numerical entry of the numeral 1 in the center panel 26, and conveys the following additional information. Again, a zero entry in triangle 30 of the center panel 26 denotes that there are no children present in the household, and the square 28 numerical entry of the numeral 1 conveys that there is one sleeping area in the household.

In the top panel 24 of the exemplary customized residential placard 46 as shown in FIG. 9, the letter N denotes that the single household resident is a night sleeper. In the bottom panel 34, entry of the letters F, O, H and P designate that there is a special fire hazard present in the household, that oxygen is in use, that the single resident occupant is a handicapped person and that there is a household pet.

As previously indicated, the top, center and bottom panels 24, 26 and 34 of the symbol color-coded backing 12 may be any suitable contrasting colors, however, preferably they are respectively red, white and blue. The material of construction of the symbol color-coded backing 12, and the die-cut adhesive letters and numbers 18, is preferably a resilient weather and tear-resistant film material, although any other material with the foregoing characteristics may be just as suitably employed.

By utilizing the residential placard system 10 components as illustrated in FIG. 1 and hereinbefore described, the exemplary customized residential placards 46 as herein shown and explained are prepared and assembled by householders to provide an efficient and effective new and novel means for enabling responding emergency personnel to quickly and safely determine and identify the occupancy status and circumstances existent within a household residence at a time of call response. And, although the residential placard system invention hereof, as well as the structural characteristics and method of employment thereof, respectively have been shown and described in what are conceived to be the most practical and preferred embodiments, it is recognized that departures may be made respectively therefrom within the scope of the invention, which is not to be limited per se to those specific details as disclosed herein but is to be accorded the full scope of the claims so as to embrace any and all equivalent such systems and methods.

We claim:

1. A residential placard system adapted to visually inform responding emergency personnel as to the occupancy status and circumstances existent within a household residence at a time of call response, said system comprising in combination:

a color-coded backing means having imprinted thereon an abutting plurality of color contrasting panels;

a first color contrasting panel of said plurality of color contrasting panels imprinted centrally intermediate upon said backing means;

a first coded symbol means imprinted upon said first color contrasting panel and adapted to receivably support a first coded conforming numeral indicia to visually designate the total number of occupants in said household residence;

a second coded symbol means imprinted upon said first color contrasting panel and adapted to receivably support a second coded conforming numeral indicia to visually designate the number of child occupants comprising the total number of occupants in said household residence;

a third coded symbol means imprinted upon said first color contrasting panel and adapted to receivably support a third coded conforming numeral indicia to visually designate the number of sleeping areas in said household residence;

a second color contrasting panel of said plurality of color contrasting panels imprinted abuttably above said first color contrasting panel and adapted to receivably support a first coded plurality of letter indicia to visually designate information specifying normal sleeping habits and locations of said household residence inhabitants;

a third color contrasting panel of said plurality of color contrasting panels imprinted abuttably below said first color contrasting panel and adapted to receivably support a second coded plurality of letter indicia to visually designate information specifying special circumstances regarding residents and hazards within said household residence; and a means for mountably affixing said color-coded backing upon a residential support surface.

2. A residential placard system according to claim 1 wherein said first color contrasting panel of said plurality of color contrasting panels is white.

3. A residential placard system according to claim 1 wherein said second color contrasting panel of said plurality of color contrasting panels is blue.

4. A residential placard system according to claim 1 wherein said third color contrasting panel of said plurality of color contrasting panels is red.

5. A residential placard system according to claim 1 wherein said color coded backing means is oval in shape.

6. A residential placard system according to claim 1 wherein said first coded symbol means is circular in shape.

7. A residential placard system according to claim 1 wherein said second coded symbol means is triangular in shape.

8. A residential placard system according to claim 1 wherein said third coded symbol means is square in shape.

9. A residential placard system according to claim 1 wherein said first coded plurality of letter indicia is comprised of the letters A, B, D, and N.

10. A residential placard system according to claim 1 wherein said second coded plurality of letter indicia is comprised of the letters F, O, S, P, and H.

11. A residential placard system according to claim 9 wherein the letter A designates attic.

12. A residential placard system according to claim 9 wherein the letter B designates basement.

13. A residential placard system according to claim 9 wherein the letter D designates a day sleeper.

14. A residential placard system according to claim 9 wherein the letter N designates a night sleeper.

15. A residential placard system according to claim 10 wherein the letter F designates a special fire hazard.

16. A residential placard system according to claim 10 wherein the letter O designates that oxygen is in use.

17. A residential placard system according to claim 10 wherein the letter S designates a senior citizen.

18. A residential placard system according to claim 10 wherein the letter P designates a pet.

19. A residential placard system according to claim 10 wherein the letter H designates a handicapped person.

* * * * *